United States Patent [19]

Bencz et al.

[11] Patent Number: 4,557,771

[45] Date of Patent: Dec. 10, 1985

[54] CHARGE LINER FOR HOLLOW EXPLOSIVE CHARGES

[75] Inventors: Győző Bencz; János Deres, both of Budapest; Péter Tuti, Érd, all of Hungary

[73] Assignees: Orszàgos Köolaj ès Gàzipari Tröszt, Budapest; Ès Robbanòanyag Felügyelet, Nagytètèny, both of Hungary

[21] Appl. No.: 479,817

[22] Filed: Mar. 28, 1983

[51] Int. Cl.[4] ..... C06B 45/12

[52] U.S. Cl. ..... 149/14; 102/307; 102/476; 149/15

[58] Field of Search ..... 102/364, 306, 475, 476, 102/307, 309; 149/37, 17, 18, 14, 15

[56] References Cited

U.S. PATENT DOCUMENTS

| | | | |
|---|---|---|---|
| 3,112,700 | 12/1963 | Gehring | 102/20 |
| 4,035,545 | 7/1977 | Ivanov et al. | 428/328 |
| 4,202,411 | 5/1980 | Sharp et al. | 166/227 |
| 4,209,351 | 6/1980 | Pierce et al. | 149/19.1 |
| 4,239,084 | 12/1980 | Sharp et al. | 166/278 |
| 4,280,409 | 7/1981 | Rozner et al. | 149/37 |
| 4,372,213 | 2/1983 | Rozner et al. | 102/301 |

FOREIGN PATENT DOCUMENTS

| | | |
|---|---|---|
| 1076543 | 8/1960 | Fed. Rep. of Germany . |
| 1182567 | 7/1965 | Fed. Rep. of Germany . |
| 1139418 | 12/1968 | Fed. Rep. of Germany . |
| 0147724 | 8/1956 | Hungary . |
| 0146290 | 12/1956 | Hungary . |

OTHER PUBLICATIONS

Chemical Abstracts, CA98-146327(18).

Journal of Applied Physics, Jun. 1948, pp. 563-582.

*Primary Examiner*—Stephen J. Lechert, Jr.

*Assistant Examiner*—Howard J. Locker

*Attorney, Agent, or Firm*—Spencer & Franl

[57] ABSTRACT

The invention relates to lining material for a hollow explosive charge with increased effectiveness mainly for the perforation of pipes of hydrocarbon-producing wells.

The lining material according to the invention consists of alloy with bismuth content and/or metal mixture with bismuth content and/or elementary bismuth.

4 Claims, No Drawings

CHARGE LINER FOR HOLLOW EXPLOSIVE CHARGES

The invention relates to lining material of a charge liner for hollow explosive charges, with increased effectiveness mainly for the perforation of pipes of hydrocarbon-producing wells.

Opening the layers for production in case of bored wells of shallow depth is carried out by building in filtering equipment made on the surface and by a framework built up from gravel of specific grain-size. In case of wells of greater depth, as for instance the hydrocarbon-producing wells, use of the filtering equipment is generally not possible. In such cases opening the layers to be set to production, or those to be investigated is carried out by perforation of the cemented steel pipe.

Purpose of the perforation is to bring about the hydraulic connection between the permeable layers transversed by drilling and within the space of the pipe, or setting the layer to production, or pressing in the layer treatment fluids, or water, gas, etc. used for displacement in case of secondary, tertiary production.

Hollow explosive charges are widely used for perforation of the pipes of hydrocarbon-producing wells. The hollow explosive charge is the most frequently used type of the explosive charges with controlled effect, where the puncturing effect ensuring the perforation is brought about by concentrating the explosion energy in the direction of the axis of the rotation-symmetric, generally conical hole. Efficiency of the energy transfer is increased to its multiple when the hole formed in the explosive charge is lined with metal. The hollow explosive charges are generally initiated in the axis of rotation at the end opposite the hole, i.e. they are induced for explosion in a suitable way, thus the wavefront of the explosion develops perpendicularly to the axis and arriving at the lining material it powerfully accelerates towards the interior of the hole. At the meeting point of the lining material—impacting along the axis—and wall of the charge a pressure of several tenthousand MPa value develops, which presses out a certain part of the lining material in axial direction at a rate possibly higher than the velocity of the explosion. The hydrodynamic theory worked out for the mathematical demonstration of the phenomenon treats the metal lining as ideal fluid due to the high pressure.

The lining materials used for the hollow explosive charges can be made of steel, aluminium, copper (J.Applied Physics 1948, 563–582), furthermor of lead, nickel, silver, magnesium, cobalt, tin, zinc or cadmium (Explosivstoffe 1959, 157–167). Known are also lining materials made of ferrous glass, ceramics with high ferrosilicon content and cast iron with high graphite content (GFR patent specification No. 1 139 418). In the GFR patent specification No. 1 076 543 the use of tin coated copper balls is disclosed as lining material. According to the Hungarian patent specification No. 146 290 sintered and pressed iron, copper or titanium powder is used for lining material, while according to the Hungarian patent specification No. 147 724 the mixture of titanium or aluminium and iron oxide is used for this purpose.

Special alloys as lining material for explosive charges are also described, as for instance antimony and nickel powder mixed into the euteric alloy of lead, antimony, tin and zinc (U.S. Pat. No. 3,112,700).

The mixture of rare earth metals too was described for the purpose of lining material (GFR patent specification No. 1 182 567).

The common drawback of all lining materials used so far for hollow explosive charges is that only a small proportion of the lining material accelerates to a very high velocity of 5000–10000 m/s and represents the cumulative jet performing the actual perforation. The major part of the lining material is shorter than the cumulative jet, but forms a cigar-shaped metal bar of large diameter, which follows the cumulative jet at a velocity lower by 50–70%. This metal mass of relatively low velocity but of larger diameter than that of the hole in many cases blocks the hole punctured into the well pipe by the cumulative jet. As a result the perforation of the cemented pipes of the hydrocarbon-producing wells will be insufficient, since so-called plug is formed in the holes.

Though no plug will be formed from the known lining materials made of metal powders, however the depth of the punctured hole is considerably less than that of the holes formed with the charges of massive metal lining. Consequently the charges provided with such lining material have not gained general acceptance in the practice.

The invention is aimed at producing such lining material for the hollow explosive charges, where perforation of the well pipe is carried out with high efficiency, i.e. a hole of large diameter will develop, while no metal plug is formed in the hole.

Above objective is attained, if alloy with bismuth content and/or metal mixture with bismuth content and/or elementary bismuth are used as lining material with increased effectiveness for the hollow explosive charges employed for the purpose of perforation of pipes of hydrocarbon-producing wells.

The invention is based on the recognition, that the known lining materials with increased effectiveness do not behave as ideal fluid during the cumulation, in spite of the existing high pressure, since tensile and shear forces arise during deformation within the lining material, and the energy used for overcoming these forces reduces the kinetic energy of the cumulative jet. On the other hand the high-speed metal-jet during its flying becomes elongated, disintegrated, as a result of the velocity gradient normally arising during cumulation, and the discontinuous cumulative jet will penetrate the target only to a limited distance. In the course of the investigations it was found that—surprisingly—the lining materials made of alloys with bismuth content and those made of the elementary bismuth itself can be shaped with negligible loss of energy, they take up high kinetic energy and behave as nearly ideal fluid in formation of the cumulative jet. So far bismuth or bizmuth alloys have not been used at all for this purpose.

The lining material with increased effectiveness according to the invention contains 0.5–100 weight percent bismuth, and it may have conventional rotation-symmetrical shape, generally cone, double cone, truncated cone, etc.

A preferable composition of the lining material for hollow explosive charges with increased effectiveness according to the invention is represented by lining materials made of eutectic alloys with bismuth content as for instance those containing 55.5% bismuth and 44.5% lead (melting point 124° C.), 58% bismuth and 42% tin (melting point 140° C.), 60% bismuth and 40% cadmium (melting point 140° C.) or 48% bismuth, 28.5% lead, 14.5% tin and 9% antimony (melting point 226°C.). These conical lining materials made of eutectic alloys containing 48–60% bismuth, apart from not bringing about plug in the hole, considerably increase the puncturing force of the hollow explosive charge. In case of conical lining material of 60° apex angle, the same hollow explosive charge is capable to accelerate effectively a lining material the mass of which is greater by 50–70%, if the above desribed eutectic alloy with bismuth content is used by itself, or mixed with copper and/or bronze powder, instead of the known copper for the material of the cone. Through reduction of the energy used for breaking down the conical lining material and coherence preserved even at the large jet-elongation, the depth of penetration will be increased by 20–60%, at the same time no massive metal plug will be fomed either.

Another preferable composition of the lining material for hollow explosive charges with increased effectiveness according to the invention is represented by lining materials made of bismuth-copper alloy with relatively low bismuth content. These alloys are extremely rigid even in case of very low, e.g. 0.7% bismuth content, and as a result of dynamic force as the detonating shock-wave, they break down to powder. Consequently they produce perforation free from plug.

A further composition of the lining material for hollow-explosive charges with increased effectiveness according to the invention is represented by lining materials consisting exclusively of bismuth. With these extremely great depth of penetration can be accomplished without plug formation.

Lining material made of bismuth according to the invention was compared with the known copper lining material. The otherwise identical hollow explosive charge provided with two types of lining material was injected into aluminium block. 20 injections were made in each case and the maximum and minimum values of the depth of penetration, as well as the average value were determined, furthermore the possible plug formation was examined. The obtained results are contained in the following table:

COMPARISON OF LINING MATERIAL WITH BISMUTH CONTENT ACCORDING TO THE INVENTION WITH THE KNOWN COPPER LINING MATERIAL

| | Lining material with bismuth content | Copper lining material |
|---|---|---|
| Depth of penetration, mm | | |
| minimum | 165 | 102 |
| maximum | 225 | 166 |
| average | 189 | 131 |
| Frequency of plug formation | 0 | 55 |

The table demonstrates that the minimum depth of penetration of the lining material according to the invention is the same as the maximum depth of penetration of the known lining material. The average depth of penetration of the lining material according to the invention is longer by 44% than in case of the known lining material.

The table clearly shows that no plug formation occurred in case of the lining material according to the invention.

The lining material with increased effectiveness according to the invention ensures several technical-economic advantages.

Due to the penetration channels of greater depth and free from plug punctured into the the cemented pipes of the hydrocarbon-producing wells, the hydraulic connection between the storage layers behind the cemented pipes and within the pipe is improved. Consequently a higher amount of hydrocarbon can be recovered from the wells.

In view of the fact that length of the penetrating channel is increased during the perforation, and the channel has no plug, the specific injection number, i.e. per unit well length can be reduced in order to attain the same flow result.

What we claim is

1. In an explosive charge shaped to define a hole therein and a charge liner bounding the hole and separating the charge from the hole, said charge liner being collapsible by the explosive force of the charge, upon ignition thereof, into a high-velocity jet for piercing a solid target material; the improvement wherein said charge liner contains at least one material selected from the group consisting of a bismuth alloy, a metal mixture with bismuth content, and elementary bismuth; and wherein the bismuth content in said charge liner is between 0.5 and 100%, whereby said charge liner behaves as a nearly ideal fluid in the formation of said high-velocity jet.

2. An explosive charge as defined in claim 1, wherein said alloy is eutectic.

3. A method of generating directed explosive energy with a hollow explosive charge, comprising the steps of using with said charge a charge liner containing at least one material selected from the group consisting of a bismuth alloy, a metal mixture with bismuth content and elementary bismuth; wherein the bismuth content in said charge liner is between 0.5 and 100%; and detonating said explosive charge, whereby said charge liner is transformed into a high-velocity jet for piercing a solid target material; said charge liner behaving as a nearly ideal fluid in the formation of said high-velocity jet.

4. A method as defined in claim 3, wherein said alloy is eutectic.

* * * * *

UNITED STATES PATENT AND TRADEMARK OFFICE

CERTIFICATE OF CORRECTION

PATENT NO. : 4,557,771

DATED : December 10th, 1985

INVENTOR(S) : Győző Bencz et al

It is certified that error appears in the above-identified patent and that said Letters Patent is hereby corrected as shown below:

In the heading of the patent, under [73], the second assignee's name should read --Vegyi- és Robbanóanyag Felügyelet--.

Signed and Sealed this

*Twenty-fifth* Day of *February 1986*

[SEAL]

*Attest:*

DONALD J. QUIGG

*Attesting Officer*

*Commissioner of Patents and Trademarks*